United States Patent [19]

Diehl

[11] Patent Number: 4,883,607

[45] Date of Patent: Nov. 28, 1989

[54] WATER-INSOLUBLE SILICATE CONTAINING DETERGENT BUILDER GRANULATE

[75] Inventor: Manfred Diehl, Frankfurt am Main, Fed. Rep. of Germany

[73] Assignee: Degussa Aktiengesellschaft, Frankfurt am Main, Fed. Rep. of Germany

[21] Appl. No.: 147,943

[22] Filed: Jan. 25, 1988

[30] Foreign Application Priority Data

Jan. 30, 1987 [DE] Fed. Rep. of Germany ..... 3702763
Oct. 21, 1987 [DE] Fed. Rep. of Germany ..... 3735618

[51] Int. Cl.[4] ..... C11D 7/02; C11D 7/20

[52] U.S. Cl. ..... 252/174.18; 252/174.17; 252/174.21; 252/174.25

[58] Field of Search ..... 252/174.25, 174.21, 252/174.17, DIG. 15, 174.18

[56] References Cited

U.S. PATENT DOCUMENTS 4,668,420 5/1987 Diehl ..... 252/135
4,683,073 7/1987 Diehl ..... 252/135
4,695,284 9/1987 Hight ..... 8/137

*Primary Examiner*—Prince E. Willis, Jr.
*Attorney, Agent, or Firm*—Beveridge, DeGrandi & Weilacher

[57] ABSTRACT

Granulated detergent builders, are disclosed consisting essentially of:

70 to 80 weight percent of water-insoluble silicate, capable of binding calcium, in the form of a finely divided, bound-water-containing, synthetically produced, water-insoluble, crystalline compound of the general formula $$(Kat)_{2/n}O)_x.Me_2O_3.(SiO_2)_y \quad (I),$$

in which Kat represents an n-valent cation which is exchangeable with calcium, x a number from 0.7 to 1.5, Me boron or aluminum and y a number from 0.8 to 6, 2 to 3 weight percent of nonionic surfactant, 0 to 1 weight percent of alkali, 2.4 to 5 weight percent of carboxymethylcellulose and/or methylcellulose, and the balance water.

4 Claims, 1 Drawing Sheet

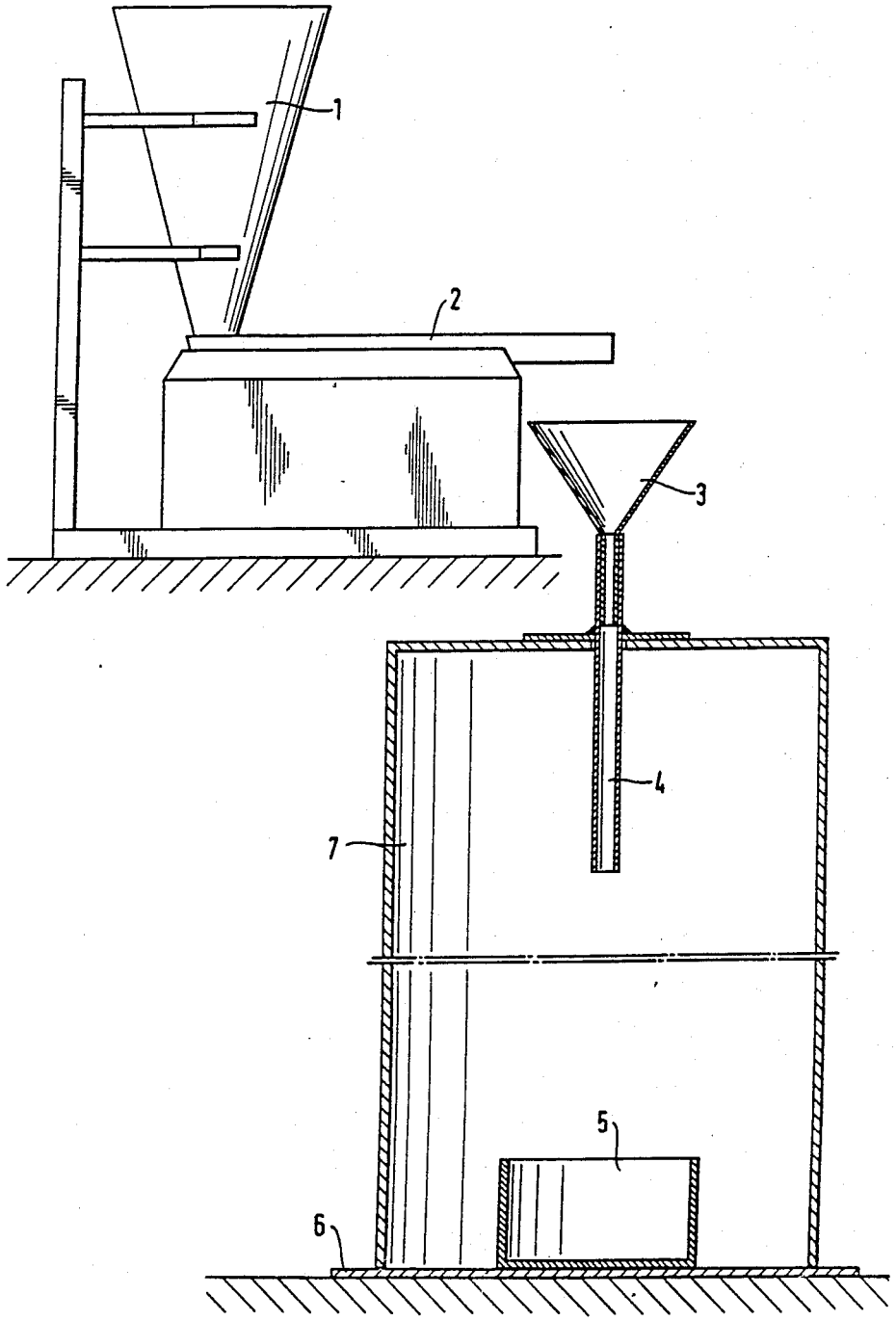
1
2
3
4
5
6
7

WATER-INSOLUBLE SILICATE CONTAINING DETERGENT BUILDER GRANULATE

INTRODUCTION AND BACKGROUND

The present invention relates to detergent builders and detergent compositions continuing same.

Powdered type A zeolite, which can be used as a phosphate substitute in detergents, represents because of its small particle size a lumpy powder which tends to agglomerate. It is difficult to mix this zeolite powder with the other detergent constituents to obtain a homogeneous powder. A complicating effect is that the finished mixture tends to resegregate.

In order to avoid this mixing problem, zeolite granules are added to the already spray-dried detergent components. These zeolite granules are produced by, among other methods, spray-drying an aqueous suspension of the zeolite powder while adding further detergent constituents.

It is known that zeolite suspensions can be mixed with sodium sulfate, spray-dried to obtain zeolite granules and admixed with the other detergent constituents (see European Laid-open application No. 870, Kali-Chemie). These known zeolite granules have the disadvantage that they do not meet the requirements imposed on them. For example, it is necessary that the zeolite granules have an undiminished calcium-binding capacity, a good particle-size stability. Of particular importance is that the dust content be as low as possible.

It is also known that granulated detergent builders can be used to produce phosphate-free detergent (West German Laid-open application No. 3,504,450). These consist of: 70 to 80 weight percent of a water-insoluble silicate, capable of binding calcium, in the form of a finely divided, bound-water-containing, synthetically produced, water-insoluble, crystalline compound of the general formula $$(Kat)_{2/n}O)_x \cdot Me_2O_3 \cdot (SiO_2)_y \quad (I),$$

in which Kat represents an n-valent cation which is exchangeable with calcium, x a number from 0.7 to 1.5, Me boron or aluminum and y a number from 0.8 to 6, 4 to 5 weight percent of sodium sulfate, 2 to 3 weight percent of nonionic surfactant, 0 to 1 weight percent of alkali, 0.5 to 1 weight percent of carboxymethylcellulose and/or methylcellulose, and the balance is water.

SUMMARY OF THE INVENTION

It is an object of the present invention to provide a granulated detergent builder, consisting essentially of: 70 to 80 weight percent of a water-insoluble silicate, capable of binding calcium, in the form of a finely divided, bound-water-containing, synthetically produced, water-insoluble, crystalline compound of the general formula $$(Kat)_{2/n}O)_x \cdot Me_2O_3 \cdot (SiO_2)_y \quad (I),$$

in which Kat represents an n-valent cation which is exchangeable with calcium, x a number from 0.7 to 1.5, Me boron or aluminum and y a number from 0.8 to 6, 2 to 3 weight percent of nonionic surfactant, 0 to 1 weight percent of alkali, 1.1 to 5 weight percent of carboxymethylcellulose and/or methylcellulose, and the balance is water.

In the detergent builder according to the present invention, the components according to formula I can be crystalline.

Preferably an aluminosilicate can be used as the component according to formula I.

In formula I, y can represent a number from 1.3 to 4.

In a preferred embodiment, the crystalline component according to formula 1 can be a type A zeolite.

The aluminosilicates according to formula I can be naturally occurring or synthetically produced products, the synthetically produced products being preferred. The production can be achieved, for example, by reaction of water-insoluble silicates with water-soluble aluminates in the presence of water. For this purpose, aqueous solutions of the starting materials can be mixed with each other, or one component existing in solid condition can be reacted with the other component existing as an aqueous solution. Even by mixing both components existing in solid condition, the desired aluminosilicates are obtained in the presence of water. Aluminosilicates can also be produced from $Al(OH)_2$, $Al_2O_3$ or $SiO_2$ by reaction with solutions of alkali metal silicates or alkali metal aluminates. The production can also be achieved by further known procedures. In particular, the present invention relates to aluminosilicates which have a three-dimensional space-lattice structure.

The preferred calcium-binding capacity, which is approximately in the range of 100 to 200 mg CaO/g AS, and mostly in the range of approximately 100 to 180 mg CaO/g AS, is found in particular in compounds of the composition:

$$0.7 \text{ to } 1.1\ Na_2O \cdot Al_2O_3 \cdot 1.3 \text{ to } 3.3\ SiO_2.$$

This empirical formula encompasses two types of different crystal structures (or the noncrystalline precursors thereof), which also differ by their empirical formulas. These are:

(1) $0.7 \text{ to } 1.1\ Na_2O \cdot Al_2O_3 \cdot 1.3 \text{ to } 2.4\ SiO_2$, (2) $0.7 \text{ to } 1.1\ Na_2O \cdot Al_2O_3 \cdot 2.4 \text{ to } 3.3\ SiO_2$.

The different crystal structures are obvious in X-ray diffraction diagrams.

The crystalline aluminosilicate present in aqueous suspension can be separated from the remaining aqueous solution and dried. The amount of bound water contained in the product depends on the drying conditions. However, after their production, the aluminosilicates do not need to be dried at all for preparation of the detergent builders according to the invention; instead — and this is particularly advantageous — an aluminosilicate which is still moist as a result of production can be used.

The particle sizes of the individual aluminosilicate particles can be very different and can lie, for example, in the range between 0.1 micron and 0.1 mm. This statement relates to the primary particle size, i.e., the size of the particles formed during precipitation and, as the case may be, during subsequent crystallization. It is particularly advantageous to use aluminosilicates in which at least 80 weight percent consists of particles with a size of 10 to 0.01 micron, especially 8 to 0.1 micron.

Preferably these aluminosilicates no longer contain primary or secondary particles with diameters larger than 45 micron. Secondary particles are defined as particles which are formed by agglomeration of the primary particles to larger structures.

As regards the agglomeration of the primary particles to larger structures, the use of aluminosilicates which are still moist as a result of their production has proved especially useful for production of the detergent builders according to the present invention, since it has been found that, by using these products which are still moist, formation of secondary particles is suppressed almost completely.

In a particularly preferred embodiment of the invention, powdered type A zeolite with an especially well-defined particle distribution is used as component A.

Such zeolite powders can be produced in accordance with West German AS No. 2,447,021, West German AS No. 2,517,218, West German Laid-open application No. 2,651,419, West German OS No. 2,651,420, West German OS No. 2,651,436, West German OS No. 2,651,437, West German OS No. 2,651,445 or West German OS No. 2,651,485. They then exhibit the particle-size distribution curves shown therein.

In a particularly preferred embodiment, a powdered type A zeolite can be used which exhibits the particle-size distribution described in West German OS No. 2,651,485.

As nonionic surfactants, addition products of 4 to 40, preferably 4 to 20 mol of ethylene oxide to 1 mol of fatty alcohol, alkylphenol, fatty acid, fatty amine, fatty acid amide or alkanesulfonamide can be used. Particularly important are the addition products of 5 to 16 mol of ethylene oxide to coconut or tallow fatty alcohols, to oleyl alcohol or to secondary alcohols with 8 to 18, preferably 12 to 18 C atoms, as well as to mono- or dialkylphenols with 6 to 14 C atoms in the alkyl groups. The addition product of 5 mol of ethylene oxide to tallow fatty alcohol is of special interest. Other than these water-soluble nonionic surfactants, however, water-insoluble or not completely water-soluble polyglycol ethers with 1 to 4 ethylene glycol groups in the molecule are also of interest, especially when they are used together with water-soluble nonionic or anionic surfactants.

As nonionic surfactants there can also be used the water-soluble addition products, containing 20 to 250 ethylene glycol ether groups and 10 to 100 propylene glycol ether groups, of ethylene oxide to polypropylene glycol alkylenediaminepolypropylene glycol and alkylpolypropylene glycols with 1 to 10 atoms in the alkyl group, wherein the polypropylene glycol chain functions as the hydrophobic group.

Nonionic surfactants of the amine oxide or sulfoxide type can also be used.

Of special interest for use as the nonionic surfactant is a mixture of at least two different fatty alcohol ethoxylates on the basis of isotridecyl alcohol or an aliphatic $C_{13}$ alcohol and ethylene oxide. This mixture can preferably consist of fatty alcohol ethoxylates With 4.5 to 5.5 EO and fatty alcohol ethoxylates with 6 to 8 EO. A mixture of at least two different alkylphenol ethoxylates of the formula

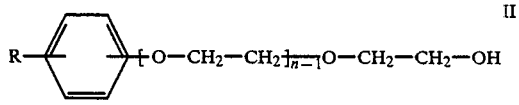

II can also be used as the nonionic surfactant.

Therein R can be an aliphatic group with 1 to 15 C atoms, for example $—CH_3$, $—C_2H_5$, propyl, butyl, hexyl, heptyl, octyl and nonyl, preferably with 9 C atoms, such as nonyl. The group R can be a substituent in ortho, meta or/and para position. Mixtures can also be used, wherein an o-substituted benzene ring is present together with a p-substituted aryl ring. Mixtures are used in which up to 90% of p-substitution and up to 10% of ortho-substitution are present.

In the formula n can represent 2 to 7, preferably 4 to 6, especially 5 in the one alkylphenol ethoxylate used in the mixture and 8 to 15, preferably 8 to 12, especially 9 or 10 in the other alkylphenol ethoxylate. However, n can also represent respectively 7 or 9 or 12 in mixtures of alkylphenol ethoxylates.

The alkylphenolethoxylates and the isotridecyl alcohol ethoxylates can be used respectively in any desired mixture, preferably in a proportion of 1:9 to 9:1, preferably 2:3 to 3:2, especially 0.9:1.1 to 1.1:0.9. Therein these alkylphenol ethoxylates correspond to the formula in which R = nonyl and n = 5 or 9.

In a preferred embodiment of the invention, the proportion of carboxymethylcellulose and/or methylcellulose can be 2.4 to 5.0 weight percent.

NaOH and/or KOH can be used as the alkali. The production of the granular detergent builder according to the present invention can be achieved by mixing the individual components together, adjusting the consistency to be suitable for spray-drying by proportioning the amount of water, and spray-drying the thusly obtained suspension by known procedures.

The granulated detergent builder according to the present invention is stable to being transported, readily redispersible and extremely low in dust.

Moreover, the product according to the present invention has an extremely high adsorption capacity for water and surfactants.

The granulated detergent builder according to the present invention can, because of its granular form, be processed to a detergent by simple mixing with the other granular detergent constituents. Segregation of the mixture does not occur.

DETAILED DESCRIPTION OF THE INVENTION

Examples

A zeolite-A filter cake according to West German OS 2,651,485 is produced The powdered type A zeolite obtained thereby exhibits the particle distribution shown therein. The zeolite A filter cake is stirred up with a dissolver and thereafter heated to 45° C. in a 50-liter vessel. Therein the nonionic surfactant is stirred in for 15 minutes at 75 to 76 rpm with a MIG stirrer, during which the temperature of the slurry rises to 50° C.

The following surfactant is used as the single component or in mixtures as the stabilizer: tallow alcohol ethoxylate 5 EO.

The suspension obtained is mixed with the other constituents listed in the tables and thereafter spray-dried (jet dryer, inlet temperature 180° C., exhaust-air temperature 75° C.).

The conveying tests were conducted on a power-operated tubular worm conveyor. The samples were subjected to one or two conveying processes. See Table 2 for the results.

The average particle sizes of the unconveyed and conveyed compound sample are presented in Table 3.

The examination of the different detergent builders according to the present invention before and after conveying revealed that the test products 1, 2 and 3, despite very large particles, exhibited the best stability. These three samples, even after two conveying processes, exhibit only a slight impairment of the flow behavior in the poured mound and thus are to be evaluated as better than the prior-art reference sample 4.

The advantages of these new products with increased CMC are already evident in the unconveyed condition, on the basis of the very low dust content (0.3 to 0.06%) and of the excellent height of only 14 mm of the poured mound.

The flowability, determined with the conical glass vessels, received "only" grade 2, because the coarse particles of the new products did not pass through the opening in glass cone 1.

All three detergent builders according to the invention exhibit an improvement in the powder properties, i.e., a greater conveying stability and a coarser particle size.

TABLE 1

| Formulations for detergent builders - test products (data in %) | | | | |
|---|---|---|---|---|
| Test Products | 1 | 2 | 3 | 4 (prior art) |
| Zeolite A* | 77.5 | 71.7 | 67.7 | 76.0 |
| Sodium sulfate | — | — | 2.5 | 4.4 |
| CMC/MC | 2.4 | 5.0 | 5.0 | 0.5 |
| Stabilizer (non-ionic surfactants) | 2.6 | 2.4 | 2.2 | 2.6 |
| Water | 17.5 | 20.9 | 22.6 | 16.0 |

*Absolutely dry, active substance

TABLE 2

| Examination of detergent builders - samples | | | | | |
|---|---|---|---|---|---|
| Test Product | Conveying | Bulk Density (g/liter) | Height poured mound (mm) | Flow-ability | Groschopp Dust test |
| 1 | unconveyed | 460 | 14 | 2 | 0.06 |
| | conveyed once | 480 | 17 | 2 | 0.15 |
| | conveyed twice | 450 | 17 | 2 | 0.17 |
| 2 | unconveyed | 410 | 14 | 2 | 0.03 |
| | conveyed once | 420 | 15 | 2 | 0.07 |
| | conveyed twice | 460 | 15 | 2 | 0.14 |
| 3 | unconveyed | 450 | 14 | 2 | 0.03 |
| | conveyed once | 460 | 15 | 2 | 0.06 |
| | conveyed twice | 470 | 15 | 2 | 0.18 |
| 4 (prior art) | unconveyed | 510 | 19 | 1 | 0.12 |
| | conveyed once | 520 | 26 | 4 | 0.28 |

TABLE 3

| Average particle size (data in microns) | | | |
|---|---|---|---|
| Test Product | 1 | 2 | 3 |
| Unconveyed | 170 | 210 | 135 |
| Conveyed Once | 150 | 175 | 125 |
| Conveyed Twice | 140 | 140 | 125 |

TABLE 4

| Test Products | 1 | 2 | 3 | 4 |
|---|---|---|---|---|
| Screen > 1.6 mm (%) | 0 | 1 | 1 | 0 |
| Screen > 0.8 mm (%) | 4 | 12 | 9 | 1 |
| Screen > 0.4 mm (%) | 36 | 45 | 38 | 21 |
| Screen > 0.2 mm (%) | 49 | 34 | 41 | 58 |
| Screen > 0.1 mm (%) | 10 | 7 | 10 | 18 |

TABLE 4-continued

| Test Products | 1 | 2 | 3 | 4 |
|---|---|---|---|---|
| Screen > 0.1 mm (%) | 1 | 1 | 1 | 1 |

The dust test according to Dr. Groschopp is conducted as follows.

The powder falling over a shaking conveyor into a cylinder is caught in a vessel placed below the shaking point, while the dust fractions settle outside this vessel on the bottom plate of the cylinder and can be determined gravimetrically. For this purpose the following devices are used:

Apparatus for dust determination, consisting of shaking conveyor

Manufacturer: AEG, type DR 50 220 V, 50 Hz, 0.15 A.

Outer cylinder

Height: 70 cm, diameter: 40 cm, closed at the top, open at the bottom

The cover plate is provided at the center with a circular opening (diameter: 3 cm) to accommodate the filling tube.

Inner cylinder

Height: 10 cm, diameter: 18 cm, closed at the bottom, open at the top.

Bottom plate

Shape: round, diameter: 48 cm.

Filling tube

Length: 30 cm, diameter: 2.5 cm, depth of insertion of the tube into the outer cylinder: 20 cm.

The depth of insertion is kept constant by a brass disk (diameter: 15 cm, thickness: 1 mm) soldered to the outside wall of the filling tube.

Funnel top diameter: 15 cm, diameter of the discharge: 1.8 cm, length of the funnel tube: 8 cm.

The apparatus is illustrated in the drawing. According to the figure, the shaking conveyor is mounted on a laboratory bench. The remaining apparatus must be arranged such that the discharge of the shaking conveyor is located directly over the center of the funnel (3) and that its distance from the top edge of the funnel is 5.5 cm.

Test Procedure:

100 g of the sample is introduced into the shaking conveyor (2) via the feed funnel (1). The frequency of the shaking funnel must be 50 Hz, and the outlet slot must be adjusted such that the substance passes through the shaking conveyor in 1 minute.

The powder falls through a funnel (3) and a filling tube (4) into the inner cylinder belonging to the test apparatus (5) and located therebelow, whereas the dust collects outside this vessel on the bottom plate (6) of the outer cylinder (7).

At the end of passage of the powder through the shaking conveyor, any powder residues remaining in the funnel are transferred into the apparatus by carefully tapping the funnel.

For slightly dusty products, 1 minute is allowed for settling and, for dusty material, the settling time is extended to 2 minutes.

The dust which has settled on the brightly polished bottom plate is collected in a weighing dish by means of a metal spatula and is accurately weighed.

The dust content is given in per cent, relative to the initial weight of sample.

Using the spray-dried detergent builder according to the invention and containing the nonionic surfactant tallow alcohol 5 EO (Example 3), the pneumatic or mechanical conveying properties were tested. For evaluation of the conveyed material, the changes in the bulk density and in the flow behavior were measured.

The sample was conveyed via an ascending worm conveyor into a material separator. In this process, the variable drive motor was adjusted to a low speed of 300 rpm.

Technical Data:

RO-FO worm conveyor system, type FR 80/D

| | |
|---|---|
| Drive speed | 300 rpm |
| Conveying length | 6.9 m, including 1 45° pipe elbow of 3 m radius<br>4 m of pipe, rising at 45° to discharge |
| Conveying height | 2.2 m |
| Tubular worm conveyor | 80 mm diameter |
| Conveying capacity | 1650 kg/hr |

The result of this test is presented in Table 2.

Virtually no change in bulk density is found for the conveyed material. The granules of detergent builder are not destroyed.

The extremely good adsorption capacity can be seen from the following test, wherein the sample according to Example 3 is used.

| Sample No. | % $H_2O$ | Flowability (fresh) |
|---|---|---|
| 1 | — | 1 |
| 2 | 5 | 1 |
| 3 | 10 | 1 |
| 4 | 15 | 1 |
| 5 | 20 | 1 |
| 6 | 25 | 1 |
| 7 | 30 | 1 |

-continued

| Sample No. | % $H_2O$ | Flowability (fresh) |
|---|---|---|
| 8 | 35 | 1 |
| 9 | 40 | 2 |
| 10 | 45 | 6 |

Grade: 1 = very good / 6 = no longer free-flowing

The determination of the flowability is described in Schriftenreihe Pigmente (Publication Series: Pigments) of Degussa AG, No. 50, page 11.

Further variations and modifications will be apparent to those skilled in the art from the foregoing and are intended to be encompassed by the claims appended hereto. German priority applications P 37,02763.8 and P 3735 618.6 are relied on and incorporated by reference.

I claim:

1. A granulated detergent builder consisting of:

70 to 80 weight percent of a water-insoluble silicate, capable of binding calcium, in the form a finely divided, bound-water-containing, synthetically produced, water-insoluble, crystalline compound of the general formula $$(Kat)2/n^{O})x \cdot Me_2O_3 \cdot (SiO_2)_y \quad (I),$$

in which Kat represents an n-valent cation which is exchangeable with calcium, x a number from 0.7 to 1.5, Me is boron or aluminum and y a number from 0.8 to 6, 2 to 3 weight percent of nonionic surfactant, 0 to 1 weight percent of alkali, 2.4 to 5 weight percent of carboxymethylcellulose and/or methylcellulose, and the balance water.

2. The granulated detergent builder according to claim 1 wherein said crystalline compound is a zeolite.

3. The granulated detergent builder according to claim 1 wherein said crystalline compound is a zeolite A.

4. The granulated detergent builder according to claim 1 wherein said crystalline compound is an aluminosilicate.

* * * * *